US007850036B2

(12) United States Patent
Cirone

(10) Patent No.: US 7,850,036 B2
(45) Date of Patent: Dec. 14, 2010

(54) PROTECTIVE COVER FOR A PAINTBALL GUN GAS CANISTER

(76) Inventor: Dominick Cirone, 5441 E. Angela Dr., Scottsdale, AZ (US) 85254

( * ) Notice: Subject to any disclaimer, the term of this patent is extended or adjusted under 35 U.S.C. 154(b) by 1171 days.

(21) Appl. No.: 11/231,788

(22) Filed: Sep. 22, 2005

(65) Prior Publication Data

US 2007/0062508 A1 Mar. 22, 2007

(51) Int. Cl.

| | |
|---|---|
| ***F17C 1/00*** | (2006.01) |
| ***B65D 65/08*** | (2006.01) |
| ***F41A 35/04*** | (2006.01) |
| ***F41B 11/00*** | (2006.01) |
| ***B65D 85/00*** | (2006.01) |

(52) U.S. Cl. ..... 220/581; 220/730; 220/903; 124/74; 42/96; 206/317; 150/154

(58) Field of Classification Search ..... 150/154, 150/901; 220/581, 730, 903; 124/45, 74; 42/96; 206/315.11, 317

See application file for complete search history.

(56) References Cited

U.S. PATENT DOCUMENTS

| | | | | |
|---|---|---|---|---|
| 1,395,485 | A * | 11/1921 | Duncan et al. | 48/4 |
| 4,401,245 | A * | 8/1983 | Zills | 224/148.3 |
| 4,540,611 | A * | 9/1985 | Henderson | 428/12 |
| 4,836,396 | A | 6/1989 | Ancona et al. | 220/212 |
| 4,989,811 | A * | 2/1991 | Millis et al. | 248/104 |
| 5,105,863 | A | 4/1992 | Cirone | 150/160 |
| 5,183,953 | A * | 2/1993 | Anderson et al. | 42/96 |
| 5,195,568 | A | 3/1993 | Cirone | 150/160 |
| 5,282,279 | A * | 2/1994 | Hinton et al. | 4/144.1 |
| 5,299,611 | A | 4/1994 | Cirone | 150/160 |
| 5,661,920 | A * | 9/1997 | Evans | 42/96 |
| RE35,899 | E | 9/1998 | Cirone | 150/160 |
| 5,931,342 | A | 8/1999 | Taylor | 222/5 |
| 5,950,611 | A | 9/1999 | Lopez et al. | 124/72 |
| 6,004,033 | A | 12/1999 | Cirone | 383/24 |
| D470,310 | S * | 2/2003 | Walley et al. | D7/624.3 |
| 6,681,821 | B1 | 1/2004 | Cirone | 150/154 |
| 2002/0189730 | A1 * | 12/2002 | Garofalo et al. | 150/154 |
| 2003/0141325 | A1 * | 7/2003 | Balogh, II | 224/101 |
| 2005/0274370 | A1 * | 12/2005 | Lubben | 124/45 |
| 2007/0164040 | A1 * | 7/2007 | DeRosier et al. | 220/730 |

* cited by examiner

*Primary Examiner*—Sue A Weaver
(74) *Attorney, Agent, or Firm*—Pillsbury Winthrop Shaw Pittman LLP

(57) ABSTRACT

A protective cover for protecting a paintball gun gas canister is disclosed. The protective cover is preferably formed from an elastic rubber material such as neoprene. The protective cover has the ability to adapt its shape when placed over a canister, thus enabling use with canisters of various sizes.

15 Claims, 8 Drawing Sheets

PROTECTIVE COVER FOR A PAINTBALL GUN GAS CANISTER

FIELD OF THE INVENTION

This invention relates generally to a protective cover for a canister or other similarly shaped object, and more particularly to a protective cover for a paintball gun gas canister.

BACKGROUND OF THE INVENTION

The sport (or game) of paintball is rapidly increasing in popularity. Many types of paintball guns exist, and most utilize compressed gas (e.g., $CO_2$) housed in a gas canister to propel or "force" paintballs at a target (e.g., usually opposing competitors). Most gas canisters are usually made of some type of metal, although other materials may be used. Various factors may cause damage to canisters, such as, for example, environmental factors. Examples of environmental factors may include, but are not limited to, prolonged exposure to sunlight, heat, cold, moisture, general inclement weather, or other environmental factors.

Canisters may also be subject to physical damage. For example, paintball is often played while running through woods or on designated playing fields. It is not uncommon for the canisters to come into contact with trees, rocks, or other objects. Canisters may also be damaged if a player falls and the canister strikes the ground. It is also not uncommon for canisters to be struck by paintballs fired from the guns of other competitors (or participants). Accordingly, dents, scrapes, scratches and other physical damage to canisters may result. In particular, $CO_2$ canisters, for example, tend to be more susceptible to the types of physical damage noted above in colder temperatures.

Environmental, physical, or other damage to a canister may raise safety concerns, particularly when the contents of the canister are under pressure. These and other drawbacks exist.

SUMMARY OF THE INVENTION

The invention overcoming these and other drawbacks relates to a protective cover for covering a gas canister used with a paintball gun. In one embodiment, the protective cover may be formed of a soft, elastic rubber material such as, for example, neoprene.

According to one embodiment, the protective cover may be substantially cylindrical in shape. Other shapes, however, may be used. In some embodiments, the shape of the protective cover may be designed to conform to the shape of the canister to be covered.

According to one embodiment, the protective cover may comprise a first end (or upper end) portion and a second end (or lower end) portion. The first end portion of the protective cover may include a first opening, and the second end portion may include a second opening. The diameter of the second opening at the second end portion may be larger than the diameter of the first opening at the first end portion.

The dimensions of the protective cover (e.g., length, diameters of first and second openings, etc.) may vary to accommodate canisters of various sizes which may be used with various types of paintball guns. For example, the protective cover may be manufactured to fit canisters as small as three (3) inches in length to over fifteen (15) inches in length. The protective cover may be manufactured to fit canisters of other sizes as well, regardless of where or how a canister interfaces with a paintball gun.

According to one embodiment, the top of a canister may be inserted into the second opening at the second end portion of the protective cover, and the protective cover may be slid down over the canister until a top portion of the canister emerges from the first opening of the protective cover at the first end portion. The ability of neoprene to stretch, as well as its "memory-specific" nature enables the protective cover to be secured to the canister without any additional attachment mechanisms.

One advantage provided by the protective cover is that it is lightweight, flexible, and easy to use, allowing for attachment to and removal from a canister in a quick and convenient manner.

Another advantage of the protective cover is its ability to protect canisters from environmental factors including, for example, prolonged exposure to sunlight, heat, cold, moisture, general inclement weather, or other environmental factors. A protective cover made of neoprene, for example, possesses insulative properties that serve to keep a canister warmer in colder temperatures, and vice versa.

Yet another advantage of the protective cover is its ability to protect canisters from physical damage including, for instance, dents, scrapes, scratches and other physical damage that may result from contact with trees, rocks, the ground, paintballs (that impact the canister), or other objects.

Still yet another advantage of the protective cover is its adaptability for maximizing the visibility of various graphics (e.g., logos, team names, etc.) provided thereon for viewing from a distance during, for example, a paintball competition. Such a feature enables participants to more readily identify other teammates and distinguish them from opposing competitors during a competition. Similarly, the protective covers may be manufactured in various different colors or patterns, or a combination of both, such that participants can more readily identify other teammates and distinguish them from opposing competitors through color coordination.

These and other objects, features, and advantages of the invention will be apparent through the detailed description of the preferred embodiments and the drawings attached hereto. It is also to be understood that both the foregoing general description and the following detailed description are exemplary and not restrictive of the scope of the invention.

DETAILED DESCRIPTION OF THE INVENTION

Figure 1A:
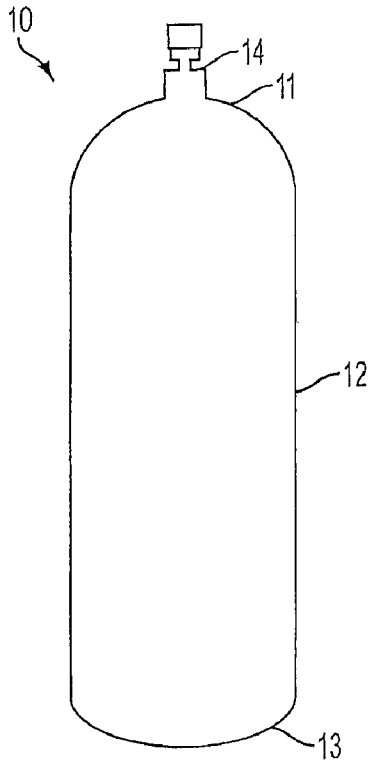
FIG. 1A is an exemplary illustration of a canister, according to an embodiment of the invention.

FIG. 1A is an exemplary illustration of a gas canister 10 that may be used with a paintball gun. Gas canister 10 may comprise a first end portion 11, an intermediate portion 12, and a second end portion 13. First end portion 11 may include a neck portion 14. In one embodiment, a fixture such as a connector, valve, or other fixture may be attached to, or removably coupled to, neck portion 14. In some embodiments, the diameter of first end portion 11 may be smaller than that of intermediate portion 12 and/or second end portion 13. In other embodiments, the diameter of first end portion 11, intermediate portion 12, and second end portion 13 may be substantially identical.

Figure 1B:
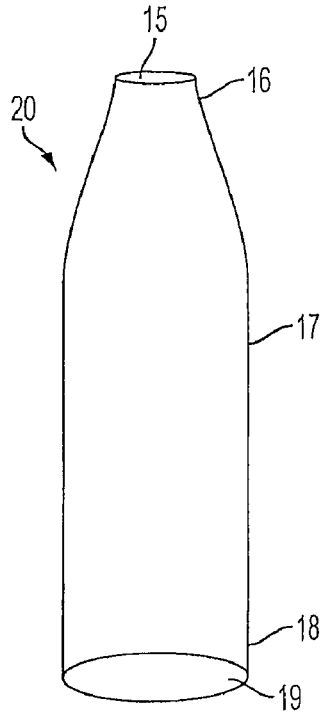
FIG. 1B illustrates a protective cover having a tapered first end portion, according to an embodiment of the invention.

FIG. 1B is an exemplary illustration of a protective cover 20, according to an embodiment of the invention. Protective cover 20 may include a first end (or upper end) portion 16, an intermediate portion 17, and a second end (or lower end) portion 18. First end portion 16 may include a first opening 15, and second end portion 18 may include a second opening 19. The diameter of first end portion 16 may be smaller than that of second end portion 18, thus enabling the top portion of a canister to slide through the second opening 19 in second end portion 18 of protective cover 20. This facilitates a tight fit of protective cover 20 over a canister without the need for a separate attachment mechanism.

According to an embodiment of the invention, protective cover 20 may be made of a soft elastic rubber such as, for example, neoprene. Neoprene's elastomeric properties enable protective cover 20 to conform to canisters of various sizes. For example, the flexible nature of neoprene may enable protective cover 20 to be secured to a canister with an intermediate portion 12 having a diameter that is slightly larger than that of intermediate portion 17 of protective cover 20.

Additionally, neoprene provides a cushioning effect to reduce the risk of physical or other damage to the canister. Moreover, neoprene possesses temperature insulation properties that serve to keep a canister warmer in colder temperatures and vice versa, thus increasing the range of temperatures in which a canister may be used. This is advantageous as $CO_2$ canisters, for example, tend to be more susceptible to greater damage in colder temperatures.

Neoprene also exhibits greater weather resistance than less elastic materials such as plastics, leather, nylon, and the like, which tend to be more susceptible to cracking, expansion, and other undesirable effects. While neoprene is one example of a material for implementing the invention, it should be recognized that any similar, elastomeric, flexible, weather-resistant, and/or insulating materials may also be used.

According to some aspects of the invention, protective cover 20 may be manufactured in a variety of ways. According to one embodiment, the cover may be made with a single cutting operation and a single sewing operation. Other techniques may be used.

Figure 2A:
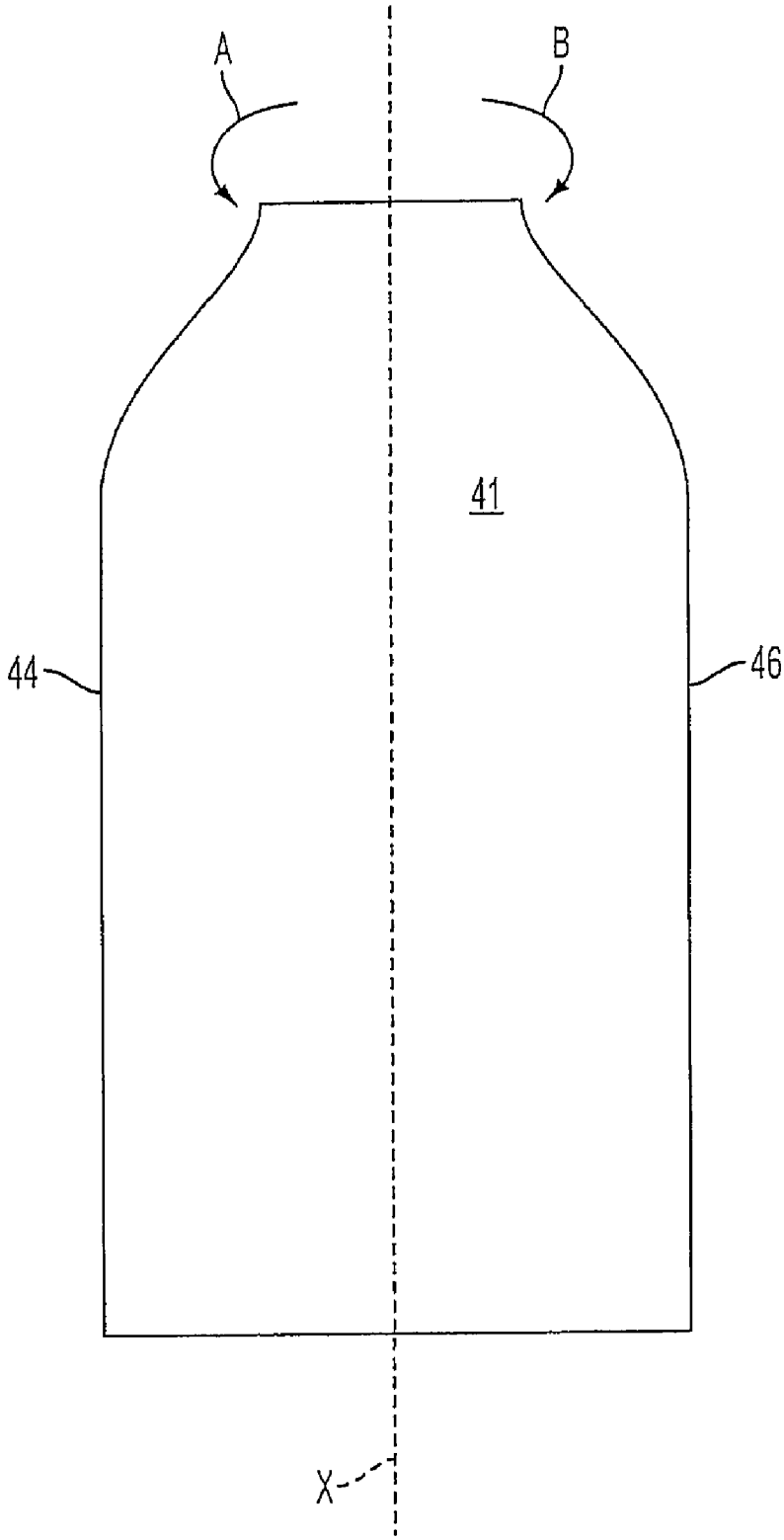
FIG. 2A illustrates a sheet used for making a protective cover for a canister, according to an embodiment of the invention.

According to an embodiment of the invention illustrated in FIG. 2A, a sheet 41 may be cut into a generally rectangular shape having a substantially first straight edge 44 and an opposing, substantially second straight edge 46. The first and second edges (44, 46) of sheet 41 may be further cut such that they are tapered along top portion 16 to conform to the shape of a typical canister. The first and second edges (44, 46) may be folded toward one another, about axis X, in the general directions illustrated by arrows A and B, respectively.

Figure 2B:
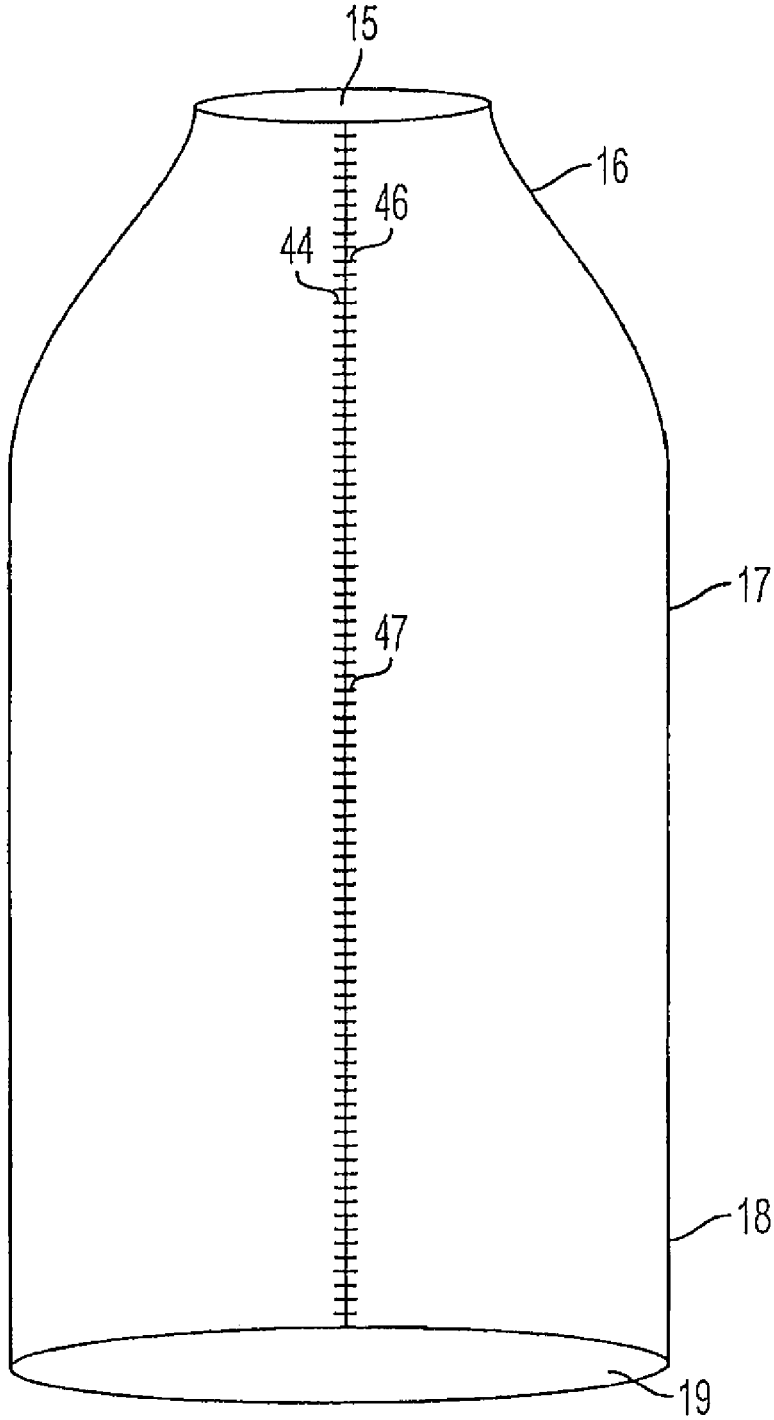
FIG. 2B illustrates a protective cover for a canister, according to an embodiment of the invention.

According to one embodiment, as illustrated for example in FIG. 2B, the first and second edges (44, 46) may then be stitched together to form a seam 47, resulting in a substantially tubular casing having first opening 15 at an upper end and second opening 19 at a lower end. As illustrated in FIG. 2B, seam 47 may extend substantially along the entire length of protective cover 20.

Figure 3:
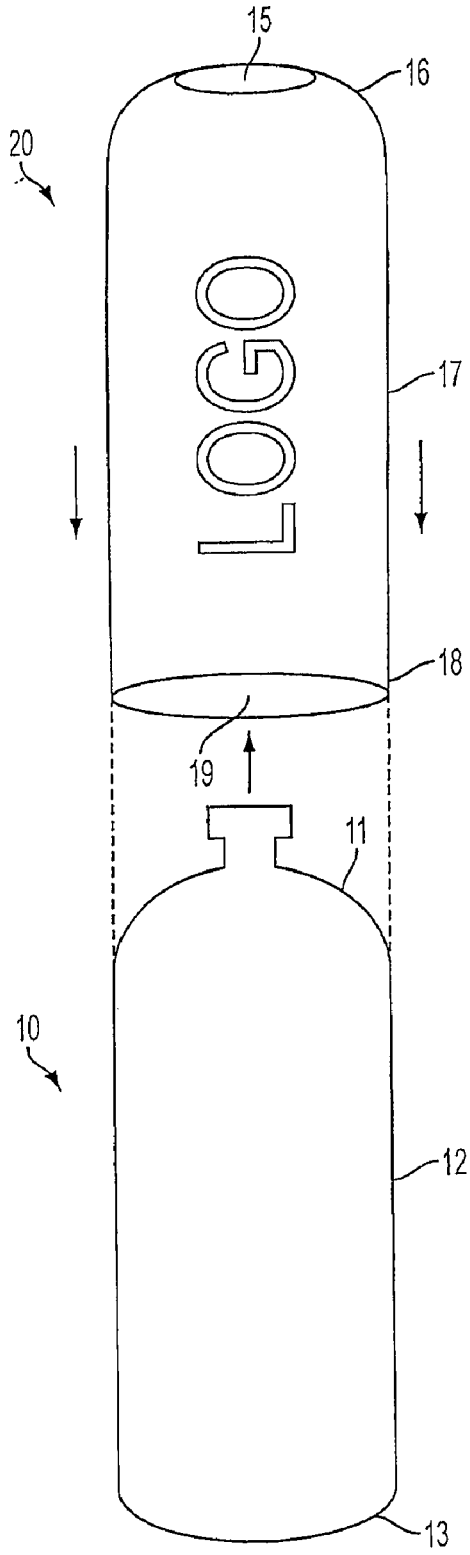
FIG. 3 illustrates a canister and a protective cover, according to an embodiment of the invention.

According to an embodiment of the invention illustrated in FIG. 3, to place cover 20 on to canister 10, a user may place first end portion 11 of canister 10 into the second opening 19 of protective cover 20. Protective cover 20 may then be slid (or stretched) over intermediate portion 12 and second end portion 13 of canister 10. The physical characteristics of neoprene and the size of first opening 15 may enable protective cover 20 to fit snugly over canister 10, ensuring that protective cover 20 remains on canister 10. Accordingly, a separate fastening mechanism may not be necessary.

Figure 2C:
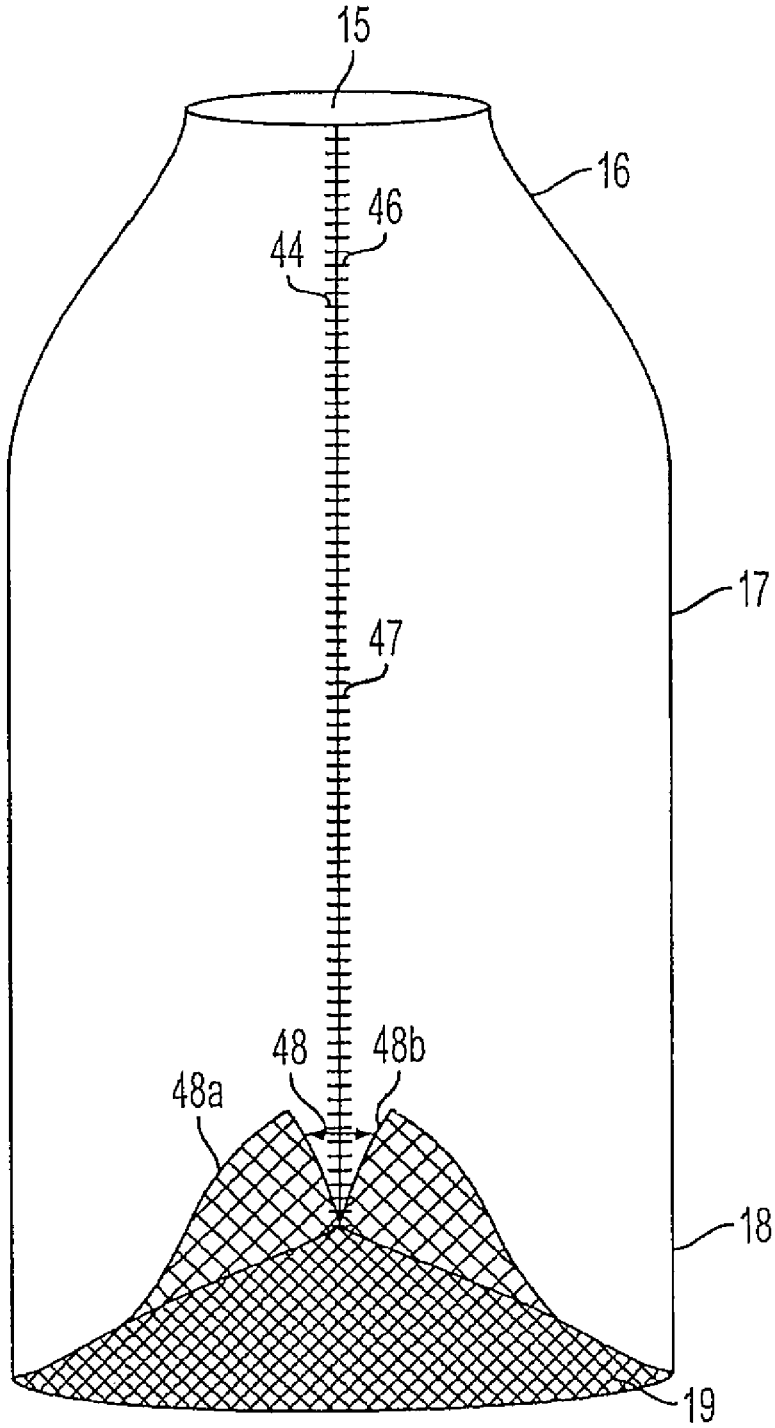
FIG. 2C illustrates a protective cover for a canister having a split opening, according to an embodiment of the invention.

In other embodiments, as illustrated for example in FIG. 2C, the first and second edges (44, 46) of sheet 41 may be stitched together to form seam 47 that extends along only a portion of the length of protective cover 20, leaving a split 48 that extends downward to opening 19. The provision of a split 48 in the protective cover 20 may allow protective cover 20 to more easily be placed over canister 10. A user, for example, can grab either one or both of the two edges (48*a*, 48*b*) of the split and pull on them to provide assistance in getting the cover on to the canister (using a method similar to that described above with reference to FIG. 3).

Any orientation, geometric description or configurations of the material pieces described or shown are illustrative only, and accordingly should not be viewed as limiting. Similarly, protective cover 20 may be manufactured using any number of pieces of material using any known manufacturing techniques or methods. Those skilled in the art will understand that one or more material pieces may be stitched, glued, or seamed together in a number of different ways to achieve the protective cover as described and illustrated in any of the embodiments herein.

The dimensions of protective cover 20 (e.g., length, diameters of first and second openings, etc.) may also vary to accommodate canisters of various sizes which may be used with various types of paintball guns. Protective cover 20 may, for example, be manufactured to fit canisters as small as three inches in length, and it may be manufactured to fit canisters as long as over fifteen inches in length. Protective cover 20 may be manufactured to fit canisters of other sizes as well, regardless of where or how a canister interfaces with a paintball gun.

Those skilled in the art will understand that the edges (44, 46) of sheet 41 may be connected, secured or fastened to one another in any of a number of ways. For example, the edges may be stitched, glued, or otherwise connected.

Edges (44, 46) may also be releasably connected, secured or fastened to one another in any of a number of ways. For instance, in some embodiments, fastening mechanisms including, but not limited to, hook and loop fasteners, button-snaps, or other fastening mechanisms (e.g., a zipper) may be used to attach the first and second edges (44, 46) of sheet 41 together.

Figure 2D:
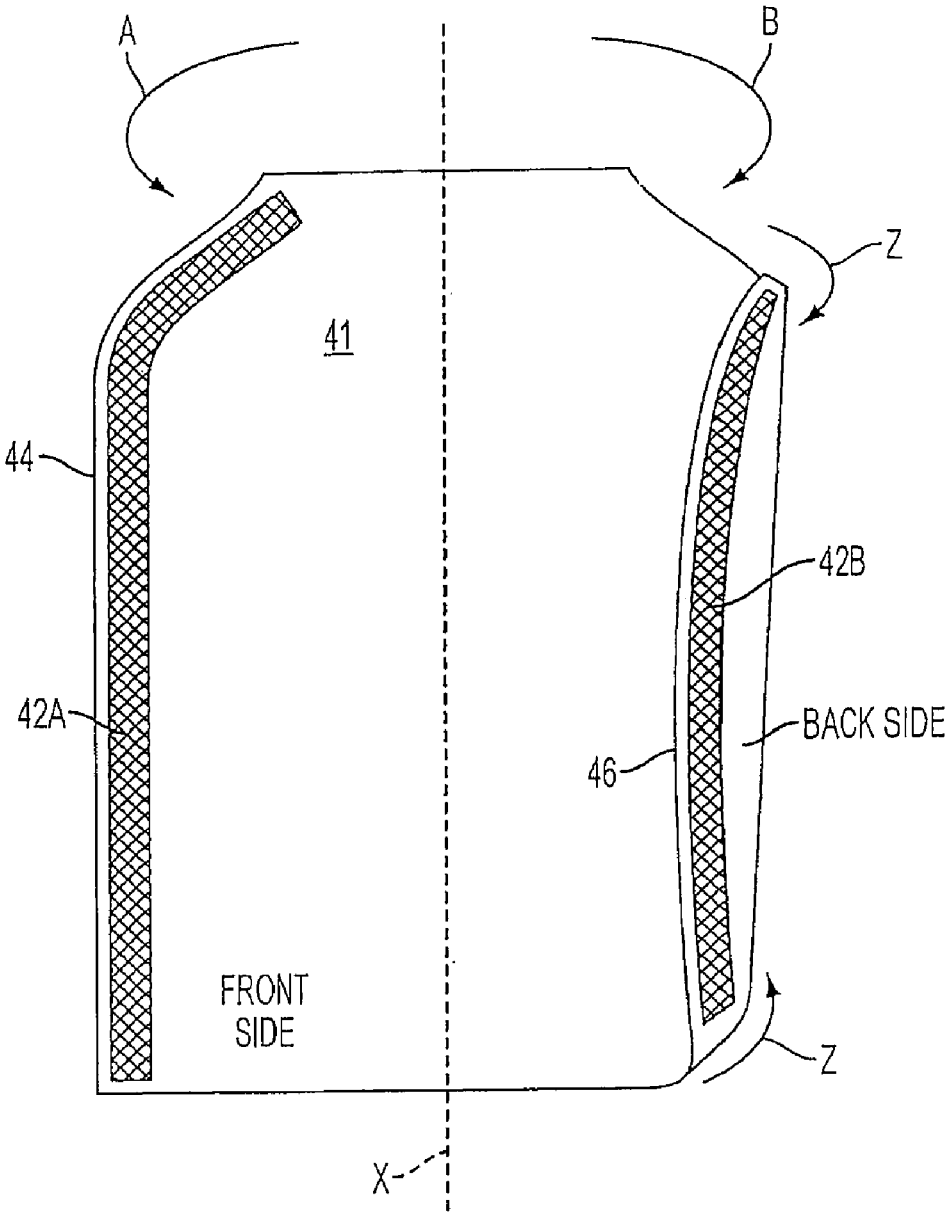
FIG. 2D illustrates a protective cover for a canister having a fastening mechanism, according to an embodiment of the invention.

In FIG. 2D, for example, a strip 42*a* of either hook or loop material may be stitched or otherwise fastened to the front side of sheet 41 along either all or a portion of first edge 44. A strip 42*b* may also be stitched or otherwise fastened to the back side of sheet 41 along either all or a portion of second edge 46. Second edge 46 has been folded over in the direction of the "Z" arrows in FIG. 2D to enable viewing of the back side of sheet 41. Strip 42*b* may comprise either hook or loop material, depending on the type of material provided on strip 42*a*. If strip 42*a* comprises hook material, for example, then strip 42*b* will comprise loop material, and vice versa. In this regard, when first edge 44 and second edge 46 are respectively folded (or wrapped) in the directions of arrows A and B around a canister (which, although not illustrated, could be placed along the X axis), then the hook material of strip 42*a* (along edge 44) would mate with the loop material of strip 42*b* (along edge 46) thus securing sheet 41 to the canister. As recited above, other types of fastening mechanisms may be placed along strips 42*a* and 42*b* such as, for example, buttons and button-snaps (to receive the buttons) respectively. Other configurations may be implemented.

Figure 2E:
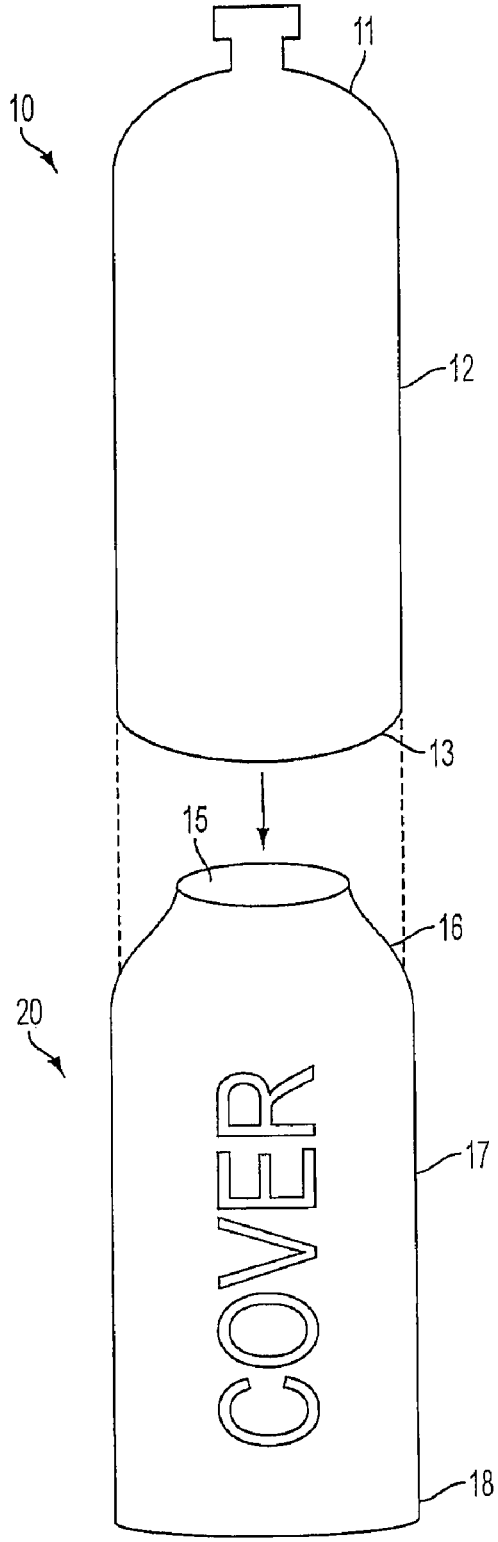
FIG. 2E illustrates a canister and a protective cover, according to an embodiment of the invention.

According to one embodiment of the invention, as illustrated in FIG. 2E, protective cover 20 may be manufactured such that second end (or lower end) portion 18 is closed off, and does not include an opening similar to second opening 19 as depicted in FIG. 1B. In this regard, the elastomeric properties of neoprene would enable first end (or upper end) portion 16 of protective cover 20 to stretch around (or over) second end portion 13 of canister 10 as second end portion 13 of canister 10 is inserted into first opening 15 of protective cover 20, and then retain a snug fit around first end portion 11 of canister 10.

In one implementation, also illustrated in FIG. 3, a logo or graphic may be printed on the surface of protective cover 20. The surface area of protective cover 20 facilitates the prominent display of a team name, company name, team logo, graphic, or other design, especially in instances when the protective cover is being viewed from a distance. This feature enables participants in a competition to more readily distinguish teammates from opposing competitors.

According to an embodiment, protective cover 20 may be manufactured in a variety of different colors or patterns, or any combination thereof, such that participants on the same team can have covers that are identical in appearance, even if the covers happen to be sized differently to accommodate canisters of different sizes used with various types (or models) of paintball guns. In this regard, during an actual competition, participants may be able to easily distinguish teammates from opposing competitors through color coordination.

Figure 4:
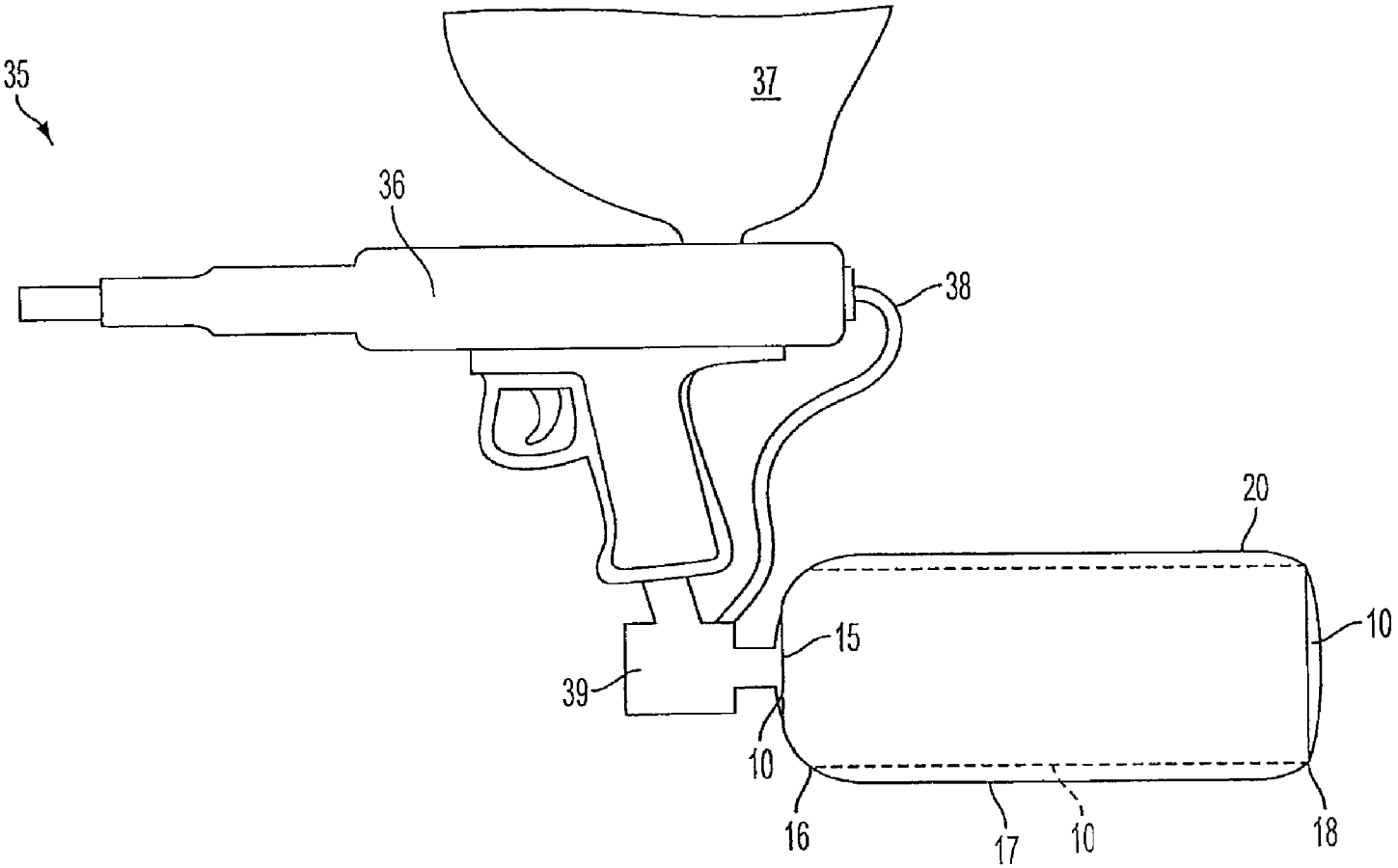
FIG. 4 illustrates a protective cover placed over a canister that is used in a paintball gun system, according to an embodiment of the invention.

FIG. 4 is an exemplary illustration of a paintball gun system 35, wherein attached canister 10 is covered by protective cover 20. Paintball gun system 35 may include canister 10, a paintball gun 36, a paintball storage receptacle 37 or "hopper," a conduit 38, and a coupling mechanism 39. As recited above, canister 10 may be used to store a compressed gas or fluid such as $CO_2$ or any other suitable gas or fluid (hereinafter "gas"). First opening 15 of protective cover 20 may prevent protective cover 20 from being removed from canister 10 when coupling mechanism 39 or paintball gun 36 is attached (or otherwise coupled) to canister 10.

Those having skill in the art will recognize that the location at which a gas canister may interface with a paintball gun may be different depending on the type of paintball gun, the size of the gas canister, or both. Some paintball guns, for example, utilize a smaller-sized (or "mini") $CO_2$ canister that is placed in front of the trigger. For a machine gun, the $CO_2$ canister may be placed between a front handle and the trigger. Regardless of the type of paintball gun utilized, or the size or placement of the gas canister, protective cover 20 may be manufactured to fit the canisters and still provide the advantages described herein.

Other embodiments, uses and advantages of the invention will be apparent to those skilled in the art from consideration of the specification and practice of the invention disclosed herein. Although the foregoing description and accompanying drawing figures relate to paintball gun gas canisters, the protective cover disclosed herein may be used to protect gas canisters (or other similarly-shaped objects) utilized in a variety of different applications. As such, the specification should be considered exemplary only, and the scope of the invention is accordingly intended to be limited only by the following claims.

The invention claimed is:

1. A paintball gun system, comprising:

a paintball gun;

a gas canister releasably coupled to the paintball gun via a coupling mechanism; and a removable, protective cover covering the gas canister, the protective cover comprising:

a sheet of material having a first edge and an opposing second edge, wherein the opposing first and second edges are each tapered inward along a first portion of the sheet toward a central axis of the sheet and fastened together so as to form a substantially tubular casing having a first opening at a first end and a second opening at a second end; and wherein the first opening has a smaller diameter than the second opening.

2. The system of claim 1, wherein the sheet of material comprises elastic rubber material.

3. The system of claim 1, wherein the sheet of material comprises neoprene.

4. The system of claim 1, wherein the opposing first and second edges are fastened together along their entire respective lengths, forming a seam that extends the entire length of the substantially tubular casing.

5. The system of claim 1, wherein the opposing first and second edges are fastened together only partially along their respective lengths, forming a substantially tubular casing having a split that extends into the second opening.

6. The system of claim 1, wherein a neck portion of the gas canister extends through the first opening of the protective cover such that the protective cover does not prevent the gas canister from being releasably coupled to the paintball gun.

7. The system of claim 1, wherein the diameter of the first opening of the protective cover is smaller than the diameter of an intermediate portion of the gas canister so as to prevent the protective cover from sliding down over the intermediate portion of the gas canister.

8. The system of claim 1, wherein the protective cover includes a graphic displayed thereon.

9. The system of claim 1, wherein the opposing first and second edges are releasably fastened together using hook and loop fastener.

10. A paintball gun system, comprising:

a paintball gun;

a gas canister releasably coupled to the paintball gun via a coupling mechanism; and a removable, protective cover for covering the gas canister, the protective cover comprising:

a sheet of elastic rubber material having a first edge and an opposing second edge that are each tapered inward along a first portion of the sheet toward a central axis of the sheet and fastened together so as to form a substantially tubular casing having a first opening at a first end and a second opening at a second end, the first opening having a smaller diameter than the second opening;

wherein the opposing first and second edges are fastened together along their entire respective lengths thereby forming a seam that extends the entire length of the substantially tubular casing; and wherein a neck portion of the gas canister extends through the first opening of the protective cover when the protective cover is covering the gas canister, such that the protective cover does not prevent the gas canister from being releasably coupled to the paintball gun.

11. A paintball gun system, comprising:

a paintball gun;

a gas canister releasably coupled to the paintball gun via a coupling mechanism; and a removable, protective cover for covering the gas canister, the protective cover comprising:

a sheet of elastic rubber material having a first edge and an opposing second edge that are each tapered inward along a first portion of the sheet toward a central axis of the sheet and fastened together so as to form a substantially tubular casing having a first opening at a first end and a second opening at a second end, the first opening having a smaller diameter than the second opening;

wherein the opposing first and second edges are fastened together only partially along their respective lengths thereby forming a substantially tubular casing having a split that extends into the second opening; and wherein a neck portion of the gas canister extends through the first opening of the protective cover when the protective cover is covering the gas canister, such that the protective cover does not prevent the gas canister from being releasably coupled to the paintball gun.

12. A paintball gun system, comprising:

a paintball gun;

a gas canister releasably coupled to the paintball gun via a coupling mechanism, the gas canister having a first end portion and a second end portion; and a removable, protective cover covering the gas canister, the protective cover comprising a sheet of elastic rubber material having a first edge and an opposing second edge that are each tapered inward along a first portion of the sheet toward a central axis of the sheet, wherein the opposing first and second edges are fastened together to form a substantially tubular casing having a first open end and a second end closed off by a piece of elastic rubber material, the first open end having a smaller diameter than the second end;

wherein the second end portion of the gas canister abuts the closed second end of the substantially tubular casing when the protective cover is covering the gas canister; and wherein the first end portion of the gas canister extends through the first open end of the protective cover when the protective cover is covering the gas canister, such that the protective cover does not prevent the gas canister from being releasably coupled to the paintball gun.

13. A protective cover for a paintball gun gas canister, the paintball gun gas canister having a first end portion and a second end portion, wherein the diameter of the first end portion is less than the diameter of the second end portion, the protective cover comprising:

a sheet of elastic rubber material having a first edge and an opposing second edge that are each tapered inward along a first portion of the sheet toward a central axis of the sheet and fastened together so as to form a substantially tubular casing having a first opening at a first end, and a second opening at a second end, the first opening having a smaller diameter than the second opening;

wherein the opposing first and second edges of the sheet are fastened together along their entire respective lengths thereby forming a seam that extends the entire length of the substantially tubular casing; and wherein the substantially tubular casing is adapted to enable a neck portion of the first end portion of the gas canister to extend through the first opening of the protective cover when the protective cover is covering the gas canister.

14. A protective cover for a paintball gun gas canister, the paintball gun gas canister having a first end portion and a second end portion, wherein the diameter of the first end portion is less than the diameter of the second end portion, the protective cover comprising:

a sheet of elastic rubber material having a first edge and an opposing second edge that are each tapered inward along a first portion of the sheet toward a central axis of the sheet and fastened together so as to form a substantially tubular casing having a first opening at a first end, and a second opening at a second end, the first opening having a smaller diameter than the second opening;

wherein the opposing first and second edges are fastened together only partially along their respective lengths thereby forming a substantially tubular casing having a split that extends into the second opening; and wherein the substantially tubular casing is adapted to enable a neck portion of the first end portion of the gas canister to extend through the first opening of the protective cover when the protective cover is covering the gas canister.

15. A protective cover for a paintball gun gas canister, the paintball gun gas canister having a first end portion and a second end portion, wherein the diameter of the first end portion is less than the diameter of the second end portion, the protective cover comprising:

a sheet of elastic rubber material having a first edge and an opposing second edge that are each tapered inward along a first portion of the sheet toward a central axis of the sheet and fastened together so as to form a substantially tubular casing having a first open end and a second end closed off by a piece of elastic rubber material, the first open end having a smaller diameter than the second end;

wherein the substantially tubular casing is adapted to enable the second end portion of the gas canister to abut the closed second end of the substantially tubular casing when the protective cover is covering the gas canister.

* * * * *